US006687472B2

(12) United States Patent
Udaka et al.

(10) Patent No.: US 6,687,472 B2
(45) Date of Patent: Feb. 3, 2004

(54) IMAGE FORMING APPARATUS AND COLOR-SHIFT CONTROL METHOD

(75) Inventors: Tsutomu Udaka, Kanagawa (JP); Kozo Tagawa, Kanagawa (JP); Ryo Ando, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/228,301

(22) Filed: Aug. 27, 2002

(65) Prior Publication Data

US 2003/0202810 A1 Oct. 30, 2003

(30) Foreign Application Priority Data

Apr. 30, 2002 (JP) ..... P. 2002-128838

(51) Int. Cl.[7] ..... G03G 15/01
(52) U.S. Cl. ..... 399/49; 347/116; 399/301
(58) Field of Search ..... 399/49, 299, 301, 399/227; 347/115, 116, 232, 234

(56) References Cited

U.S. PATENT DOCUMENTS 5,631,686 A * 5/1997 Castelli et al. ..... 347/116
6,246,856 B1 * 6/2001 Kopp et al. ..... 399/299

FOREIGN PATENT DOCUMENTS

JP 8-248721 A 9/1996

* cited by examiner

*Primary Examiner*—Joan Pendegrass
(74) *Attorney, Agent, or Firm*—Morgan, Lewis & Bockius LLP

(57) ABSTRACT

An image forming apparatus has a plurality of image forming units for forming images in various colors, and transfers images formed by these image forming units onto a transfer belt an overlapping manner. The image forming apparatus includes a control unit for outputting a predetermined control signal in order to form a color-shift detecting pattern with respect to the transfer belt by employing a plurality of these image forming units, and a pattern detecting sensor for reading the color-shift detecting pattern formed on the transfer belt by this control unit. Under normal operation, the control unit controls forming operation of color-shift detecting patterns by using only commonly-used color image forming units, while the control unit does not form a color-shift detecting pattern by using a specific-color image forming unit.

13 Claims, 8 Drawing Sheets

IMAGE FORMING APPARATUS AND COLOR-SHIFT CONTROL METHOD

The present disclosure relates to the subject matter contained in Japanese Patent Application No.2002-128838 filed on Apr. 30, 2002, which are incorporated herein by reference in its entirety.

BACKGROUND OF THE INVENTION

1. Field of the Invention

The present invention is related to an image forming apparatus such as a printer and a copy machine. More specifically, the present invention is directed to an image forming apparatus and the like, which is equipped with a plurality of recording apparatus for forming respective color images.

2. Description of the Related Art

Conventionally, image forming apparatus such as color printers and color copy machines have been widely used in which images having various colors are overlapped with each other to be formed on a single recording medium such as paper. In these image forming apparatus, color shifts (positional shifts) of the respective colors which are formed by a plurality of image forming units may cause a problem. For instance, in the case that a so-called "tandem type image forming apparatus" is employed in which a plurality of image forming units provided with respect to the respective colors are arranged side by side opposite to a transfer belt, such a color shift (color deviation) may occur, because of errors contained in the respective mounting positions of these plural image forming units, errors contained in peripheral speeds of the respective image forming units, differences in exposure positions with respect to the transfer belt, changes contained in linear speeds of the transfer belt, and the like. In other words, for example, in the case of such an image forming apparatus which employs the so-called "tandem system", the alignments of the image forming units provided with respect to the respective colors and the mechanical errors directly cause the color shifts on the recording medium (paper etc.). As a result, in the image forming apparatus employing such a tandem system, a color shift control (registration control) is necessarily required, by which amounts of these color shifts are measured, and occurrences of these color shifts may be suppressed.

As this color-shift control operation, for instance, JP-A-8-248721 discloses such a technique that while marks having Y(yellow) color, M(magenta) color, C(cyan) color, and K(black) color are drawn on a transfer belt, the positions of these marks are read by a sensor, and color shifts are calculated based on sensor readout results, by which an image writing unit is controlled.

On the other hand, as a trend in future's color printers, with respect to a full-color printer having the above-described four colors of Y, M, C, K corresponding to commonly-used colors (normal colors), an image using an image forming member such a specific-color which could not be represented, or could be hardly represented will be formed by this full-color printer. For instance, as this image forming member, there are corporate colors which are exclusively used by specific users, forming toners in braille, and toners capable of improving fluorescent colors and glosses. In the case that a printing operation is carried out by using these specific-colors with respect to these conventional four (Y, M, C, K) colors, a specific-color image forming unit for printing out this specific-color must be arranged side by side with respect to the image forming units for printing the normal colors.

In this case, even when the specific-color image forming unit for forming the image by employing the image forming member such as the specific-color is arranged, the above-described color-shift control operation is required. However, since the processing operation as to the specific-color is different from the processing operations as to the normal colors such as Y, M, C, K, such a simple color-shift control operation that the color is merely increased and the color-shift control operation is simply executed cannot be practically accepted. For instance, in such a case that a use frequency of an additionally provided specific-color is low, it is not preferable to execute a color-shift control operation as to this specific-color, which is similar to the color-shift control operation of the normal colors. In particular, generally speaking, since cost of toners (image forming members) of these specific-colors is high, if the color-shift control operation is higher frequently carried out, then cost-up aspects caused by useless consumption of these toners (image forming members) cannot be negligible.

Also, for instance, considering now such an example that a foaming toner in braille is employed as a specific-color, a requirement of positional precision as to a print out operation thereof by using this forming toner is lower than that required to print out the normal color. As a result, if the color-shift control operation similarly executed with respect to the normal color is carried out as to such a foaming toner (image forming member), the necessary positional precision of which is low, then this color-shift control operation becomes useless. Furthermore, there is such a case that a certain image formed by using a specific-color cannot be read by merely employing the conventionally-used sensor. Also, although a specific-color itself can be read, there is another case that for instance, after a pattern made of this specific-color has been formed on a transfer belt, this specific-colored pattern of the transfer belt cannot be read by employing the above-described sensor in relation to this transfer belt (namely, specific-color cannot be discriminated from color of transfer belt).

SUMMARY OF THE INVENTION

The present invention has been made to solve the above-described problems of the conventional techniques, and therefore, has an object to execute a suitable color-shift control operation which is fitted to a feature of an image forming unit while color-shift control operations in a plurality of image forming units are carried out.

Another object of the present invention is to execute a suitable color-shift control operation in an image forming apparatus which mounts thereon an image forming unit for a specific-color other than image forming units for commonly-used colors.

To achieve the above-described objects, according to the present invention, in an image forming apparatus such as a full-color printing apparatus employing, for example, a tandem system, both a color-shift control operation as to commonly-used colors, e.g., Y, M, C, K, and another color-shift control operation as to all colors including a specific-color are carried out in a discriminative manner. In other words, in an image forming apparatus in which images are overlapped with each other by employing "a (symbol "a" being integer larger than, or equal to 3)" pieces of image forming units for forming images, and then the overlapped image is transferred, a first color-shift control means executes a color-shift control operation by employing "b (symbol "b" being integer larger than, or equal to 2, and being defined by b<a)" pieces of image forming units; and a second color-shift control means executes a color-shift control operation by employing either a partial or all of (a-b) pieces of the image forming units where a color-shift detection is not carried out in the first color-shift control means in accordance with a condition different from that of the first color-shift control means.

In this case, the second color-shift control means may execute the color-shift control operation based upon a job using (a-b) pieces of image forming units. For instance; in the case that (a-b) pieces of image forming units form an image having a specific-color, the second color-shift control means may execute the color-shift control operation before the job in which this specific-color is used, or before one time after the job using such a specific-color has been carried out several times.

Also, the image forming apparatus may be further comprised of a switching means for switching a detection level of a sensor and/or a color-shift detecting pattern by both the first color-shift control means and the second color-shift control means. As this switching means, for example, when the specific-color is read out, a switching means may switch the gain of the sensor and/or the light amount. Also, when the specific-color is read out, another switching means may switch a threshold level while a color-shift detecting pattern is sensed.

Also, an image forming apparatus, according to the present invention, is featured by such an image forming apparatus having a plurality of image forming units for forming various color images, for overlapping the images formed by the plural image forming units with each other to transfer the overlapped image, comprising: a control unit for forming a color-shift detecting pattern with respect to a predetermined transfer member by employing a plurality of image forming units; and a pattern-detecting sensor for reading the color-shift detecting pattern formed on the transfer member by the control unit. Then, this control unit does not execute forming of the color-shift detecting pattern to the transfer member with respect to a specific image forming unit among a plurality of image forming units. In this case, this transfer member may involve not only an intermediate transfer member, but also a transfer member carrier (for example, paper transport belt) which transports a sheet material, which will be similarly applied to the below-mentioned explanations.

In this case, when the control unit may form the color-shift detecting pattern onto the transfer member under different condition with respect to the specific image forming unit among a plurality of image forming units, there is such a merit that the color-shift detecting pattern may be properly formed in this specific image forming unit, which is fitted to use conditions.

Also, when the control unit may form the color-shift detecting pattern by using the specific image forming unit at an area of the transfer member, where another image forming unit forms the color-shift detecting pattern which is replaced by the above-described color-shift detecting pattern, there is such a merit that even when the area for forming the color-shift detecting pattern is, for example, narrow, the color-shift detecting pattern may be formed thereon by the specific image forming unit.

Furthermore, this control unit may form the color-shift detecting patterns by employing other plural image forming units with respect to the transfer member, while an area allocated to the specific image forming unit where the color-shift detecting image is not formed, is used as a blank area. In addition, in the case that the color-shift detecting pattern is formed onto the transfer member with respect to this specific image forming unit, this color-shift detecting pattern may be formed onto this blank area. As a result, there are such superior features that the algorithm used to form the color-shift detecting pattern need not be largely changed by checking as to whether or not the color-shift detecting pattern is formed by the specific image forming unit.

Also, an image forming apparatus, according to another aspect of the present invention, is featured by such an image forming apparatus comprising: a plurality of commonly-used color image forming units arranged side by side with respect to a transfer unit, for forming a Y(yellow)-colored image, an M(magenta)-colored image, a C(cyan)-colored image, and a K(black)-colored image; a specific-color image forming unit for forming a specific-color image, which is arranged on an upstream side and/or a lower-stream side of the commonly-used color image forming units with respect to a sequence of forming the color images by the commonly-used color image forming units; and a control unit for executing a color-shift control operation by using the commonly-used color image forming units and/or the specific-color image forming unit.

In the case that the specific-color is a light color, when the specific-color image forming unit is arranged on the upstream side of the commonly-used image forming units, there is such a merit that the first print-out speed can be increased. Also, in the case that the specific-color is a dark color, the specific-color image forming unit may form a color-shift detecting pattern on an image having a light color, which is formed by the commonly-used image forming units.

Furthermore, the transfer unit may provide a drawing area of a color-shift detecting pattern which is formed by the specific-color image forming unit in a discriminative manner with respect to other areas. For example, since colors, transmittance, reflectance, and the like are changed with respect to this drawing area of the color-shift detecting pattern, this drawing area may be discriminated from other areas.

On the other hand, a color-shift control method, according to another aspect of the present invention, is featured by such a color-shift control method of an image forming apparatus in which images are overlapped with each other by employing "a (symbol "a" being integer larger than, or equal to 3)" pieces of image forming units for forming images, and then the overlapped image is transferred, comprising: a first step for forming a color-shift detecting pattern by employing "b(symbol "b" being integer larger than, or equal to 2, and being defined by b<a)" pieces of image forming units; and a second step for forming a second color-shift detecting pattern by employing either a partial or all of (a-b) pieces of the image forming units where a color-shift detection is not carried out in the first step in accordance with a condition different from that of the first step.

In this color-shift control method, in such a case that a severe setting operation is not always required for the color-shift detecting pattern formed in this second step, this color-shift detecting pattern may be formed as a pattern which is exclusively used to execute a coarse adjustment, and/or a pattern for a visible chart executed by a user.

DETAILED DESCRIPTION OF THE PREFERRED EMBODIMENTS

The present invention will now be described in detail based upon embodiments shown in the accompanying drawings.

Figure 1:
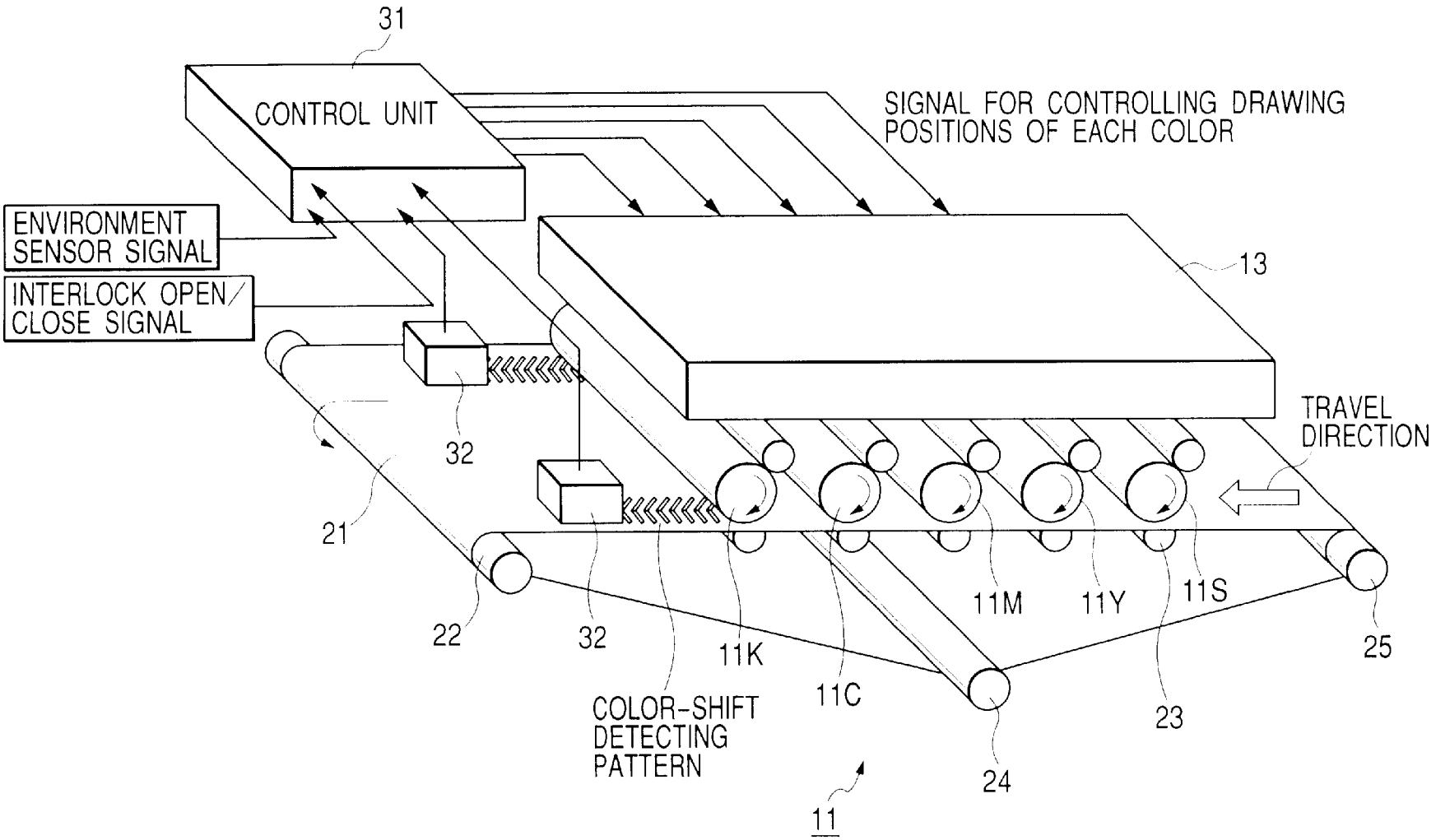
FIG. 1 is a diagram for indicating an image forming apparatus to which an embodiment of the present invention is applied.

FIG. 1 is a diagram for schematically indicating an image forming apparatus to which this embodiment of the present invention is applied. This image forming apparatus is a so-called "tandem type digital color electrophotographic machine", which employs an electronic photographic system. This tandem type digital color electrophotographic machine has an image forming unit 11 containing a specific-color image for forming unit 11S and commonly-used color image for forming units 11Y, 11M, 11C, 11K, an exposing device 13, and a transfer belt 21. The commonly-used color image forming units 11Y, 11M, 11C, and 11K form respective color images such as a yellow (Y) image, a magenta (M) image, a cyan (C) image, and a black (K) image. The specific-color image forming unit 11S forms a specific-color image. The exposing device 13 forms electrostatic latent images with respect to these image forming units 11 (namely, 11Y, 11M, 11C, 11K, and 11S). The transfer belt 21 functions as an intermediate transfer member, which is made in contact with, for instance, the image forming units 11, and transfers images formed by these image forming units 11 by overlapping these images with each other. Also, a drive roller 22 for driving this transfer belt 21, a plurality of primary transfer rollers 23, a secondary transfer roller 24, and a back-up roller 25 are provided inside the transfer belt 21. The plurality of primary transfer rollers 23 are provided opposite to photosensitive members of the image forming unit 11, and form images on the transfer belt 21. The secondary transfer roller 24 transfers a color image formed on the transfer belt 21 to a recording medium such as paper (recording sheet). Each of the primary transfer rollers 23 specifies a primary position with respect to the transfer belt 21. The back-up roller 25 then positions the transfer belt 21 in the primary travel direction (shown as ⇦) that is substantially parallel to the exposing device 13. Also, this image forming apparatus has a control unit 31, and a pattern detecting sensor 32. The control unit 31 supplies such a color-shift detecting pattern information to the exposing device 13 and the image forming unit 11. The pattern detecting sensor 32 reads a color-shift detecting pattern which is formed in a predetermined area of the transfer belt 21.

The image-forming unit 11 has a developing device, a paper transferring member or an intermediate transfer member, a charging device, a photosensitive drum and an exposure device. The developing device forms images using different color toners on the commonly-used color image forming unit 11Y, 11M, 11C, 11K and the specific-color image forming unit 11S, respectively. The image carrying bodies such as photosensitive drums carry the images formed with the toners supplied from the developing device. The charging device charges the photosensitive drums. The various sorts of image forming units such as a cleaner for removing remaining toners. In this case, it is assumed that colors frequently used in normal color representations such as yellow (Y), magenta (M), cyan (C), and black (K), are defined as commonly-used colors. The specific-color image forming unit 11S can form an image having a specific-color (namely, specific image forming material), while the specific image forming material is not the commonly-used colors, but is not employed to form the normal color image. As this specific-color (specific image forming material), for instance, there are a corporate color, which is exclusively used by a specific user (for example, a green color of a specific film company and a red color of a specific beverage company), a foaming toner for braille, a fluorescent color and toners capable of improving a gloss. A predetermined specific-color toner is stored in the developing device of the specific-color image forming unit 11S. It should be noted that alternatively, as the commonly-used colors, six colors, or more colors including a dark yellow color in addition to the above-explained four colors Y, M, C, K may be employed. Also, as apparent from the above-explained example, the expression "specific-color" implies not only that color is limited to only the specific-color, but also specific image forming material having a material and/or a characteristic other than a material and a characteristic used for the normal color image formation as the commonly-used color. In other words, the specific-color image forming unit 11S maybe referred to as an "optional image forming unit 11" with respect to the image forming unit 11 used for the normal color.

The exposing device 13 has, for example, a laser ROS (Raster Output Scanner) and an LED array. The exposing device 13 applies light to the photosensitive drum, which each of image forming unit 11 has, to form an electrostatic latent image. The exposing device 13 is supplied digital image signals with respect to each of colors via the control unit 31 to the exposing device 13. The digital image signals are obtained from, for instance, an image reading apparatus (IIT) and an external personal computer apparatus (PC). An image processing apparatus (not shown) converts the digital image signals before supplied to the exposing device 13. Also, a digital image signal is written with respect to the specific image forming unit 11S by designating a specific-color by a user. The control unit 31 produces a pattern image used to detect a color shift (color deviation). The pattern image is supplied to the exposing device 13. The pattern image is supplied as a control signal of an image writing position as to each of colors to the exposing device 13 corresponding to each of image forming units 11. The pattern image, for instance, is printed on portions, which are located at both edge portions of the transfer belt 21 perpendicular to a travel direction of this transfer belt 21 and are not related to image forming onto a recording medium, at a predetermined interval in the travelling direction of the transfer belt 21 with respect to each of colors. The control unit 31 sets timing every color based upon the writing positions and supplies a control signal.

A pattern detecting sensor 32 may be a reflection type sensor. The reflection type sensor focuses a color-shift detecting pattern (ladder-shaped toner patch, and Chevron patch), which is formed on an opaque transfer belt 21, onto a detector, and when a gravity center line of the patch is made coincident with a center line of the detector, the reflection type sensor outputs a pulse. The detector has two sets of Bi-Cells (namely, two split diodes), which are positioned at an angle of 90 degrees. In order to detect a relative color shift of the color-shift detecting patterns formed of patches formed by the respective image forming unit 11, two sets of the pattern detecting sensors 32 are arranged in a downstream side of the commonly-used color image forming unit 11K located at the lowermost stream side and also are arranged on an axis perpendicular to a sub-scanning direction. A light emitting unit of the pattern detecting sensor 32 uses, for example, two infrared LEDs (having wavelength of 880 nm) and light emission amounts of the two infrared LEDs can be controlled (for example, two stages of light emission amounts) in order to secure a stable pulse output.

An endless belt may be employed as the transfer belt 21. The endless belt is formed by forming a synthetic resin film such as polyimide having a flexible characteristic in a belt shape and connecting both ends of the belt-shaped synthetic resin film to each other by means of welding methods. Also, for instance, when the transfer belt 21 requires an electric conductivity characteristic, electric conductive polymer is used so that a surface of this transfer belt 21 becomes blackish. The transfer belt 21 is tensioned in a substantially linear manner by the drive roller 22 and the back-up roller 25. With respect to the substantially linear portions, both the image forming unit 11 and the primary transfer roller 23 located opposite to this image forming unit 11 are arrayed in a constant interval along the substantially horizontal direction. In the example shown in FIG. 1, with respect to the travel direction of the transfer belt 21, the specific-color image forming unit 11S is disposed on an upstream side of the transfer operation. The commonly-used color image forming unit 11Y for the yellow color, the commonly-used color image forming unit 11M for the magenta color, the commonly-used color image forming unit 11C for the cyan color, and the commonly-used color image forming unit 11K for the black color are arranged in this order along the downstream direction. Generally speaking, a use frequency as to a specific-color is lower than that as to a commonly-used color. When the specific-color image forming unit 11S whose use frequency is low is disposed on the lowermost stream side, a first print-out speed is delayed by such a time during which a first image passes through an area where the specific-color image forming unit 11S is located. As a consequence, in an image forming apparatus capable of printing out a specific-color, the specific-color image forming unit 11S is preferably arranged on the upstream side in order to improve the first print-out speed. However, there is another case that it is not preferable to arrange the specific-color image forming unit 11S on the upstream side because of a relationship between the color of the transfer belt 21 and the specific-color (will be discussed later).

The respective color images formed by the image forming unit 11 are sequentially overlapped onto the transfer belt 21 due to travelling of the transfer belt 21. A color toner image, which has been formed on the transfer belt 21 by overlapping the images is transferred onto a recording medium (not shown) at a position of the secondary transfer roller 24, a transfer timing of which is fitted to a transport timing of the recording medium (recording sheet). The recording medium to which the color toner image has been transferred is transported to a fixing device (not shown) to fix the color toner image on the recording medium. Then, the recording medium on which the color toner image has been fixed is discharged to an discharge tray, which is provided with the image forming apparatus.

In this case, in accordance with this embodiment, positional-shift detecting patterns are sequentially formed by the plurality of image forming units 11 for the different colors. The positional-shift detecting patterns are detected by the pattern detecting sensor 32 corresponding to a pattern detecting unit. Therefore, it is possible to correct the positional shifts with respect to the color images overlapped.

At this time, in accordance with a feature of this embodiment, the positional-shift control operation with respect to the specific-color image forming unit 11S is separately handled from the positional-shift control operation with respect to the normally-used image forming units 11Y, 11M, 11C, and 11K. In other words, assuming now that a total number of these image forming units 11 is "a" pieces (symbol "a" being any integer larger than or equal to 3, e.g., symbol "a" being 5 in example of FIG. 1), when the normal positional-shift control operation is carried out, the color-shift control operation is performed by "b" pieces of image forming units 11. It should be understood that symbol "b" is any integer larger than or equal to 2 and also is smaller than symbol "a". Four pieces of image forming units 11Y, 11M, 11C, 11K are used to execute this color-shift control operation in the example of FIG. 1. As to "a-b" pieces of image forming unit 11 (namely, one image forming unit 11S in example of FIG. 1) by which the color-shift control is carried out, the color-shift control operation is carried out at preselected timing, which is different from the timing for the above-described color-shift control operations by "b" pieces of image forming units. Incidentally, when (a-b) is not equal to 1, but is larger than or equal to 2, such a color-shift control operation may be carried out by only a portion of the plurality of image forming units or all of the image forming units.

Generally speaking, the use frequency of the specific-color, which the specific-color image forming unit 11S uses to form an image as shown in FIG. 1, is lower than that of the commonly-used color (normal color). Therefore, it is not preferable to execute the color-shift control operation with respect to the specific-color in a similar manner to the commonly-used color. In particular, since manufacturing amounts of the specific-colors are small, manufacturing cost thereof is very high. Therefore, when the color-shift control operation is frequently carried out, cost-up matters caused by useless consumption of specific-color toners are not negligible. It is assumed to use a foaming toner in braille as the specific-color. A requirement of positional precision as to printing of the foaming toner is lower than that as to printing of the commonly-used color. When a color-shift control operation for the foaming toner is carried out in a similar manner to that of the commonly-used color, the color-shift control operation for the foaming toner becomes useless. As a consequence, it is preferable to execute the color-shift control operation of the specific-color image forming unit 11S at a different timing from a timing of the color-shift control operations of the commonly-used color image forming units 11Y, 11M, 11C, 11K.

The control unit 31 outputs a position control signal to the exposing device 13 and the image forming unit 11 at the predetermined timing. The position control signal is used so as to form a color-shift detecting pattern by employing the specific-color image forming unit 11S. The predetermined timing implies, for instance, a timing before a job of using the specific-color image forming unit 11S contained in the above-described (a-b) pieces of image forming units 11 or implies such a timing before the job is executed several times. The predetermined timing may be automatically controlled by thinning operation. Also, the control unit 31 may output such a positional control signal one time after the color-shift control operations of the normal "b" pieces of commonly-used color image forming units 11Y, 11M, 11C, 11K are carried out several times, one time when a date is changed after the preceding color-shift control operation has been carried out, or one time after several hours have elapsed or several days have passed. Namely, the predetermined timing may be automatically controlled by thinning operation. Furthermore, the thinning frequency may be arbitrarily set based upon, for example, a desirable thinning frequency specified by a user and a sort of specific-colors.

Also, the color-shift control operation using the specific-color image forming unit 11S may be carried out when this specific-color image forming unit 11S is replaced, namely, when an image forming unit of a specific-color contained in the above-described (a-b) pieces of image forming units, or parts thereof are replaced (note that when electronic photographic system is not employed, these parts correspond to ink-jet head, thermal head, photosensitive member, developer, exposing device 13 etc.). Furthermore, in the case that a level of an environmental variation is changed higher than, or equal to a predetermined level (for example, temperature is increased higher than, or equal to 5° C.) after the preceding color-shift control operation has been carried out, or in the case that a value of vibration shock is increased higher than, or equal to a predetermined value (for instance, vibration value higher than, or equal to 5G), and/or in such a case that a specific interlock is opened (for example, door of image forming apparatus is opened), the color-shift control using the specific-color image forming unit 11S may be carried out. Furthermore, in the case that a color-shift control execution request command is entered from a user (involving service staff member), and/or in such a case that when a plurality of process speeds are provided, this process speed is switched, while the above-described timing is employed as the predetermined timing, the color-shift control operation of the specific-color contained in the (a-b) pieces of image forming units may be carried out.

Figure 2:
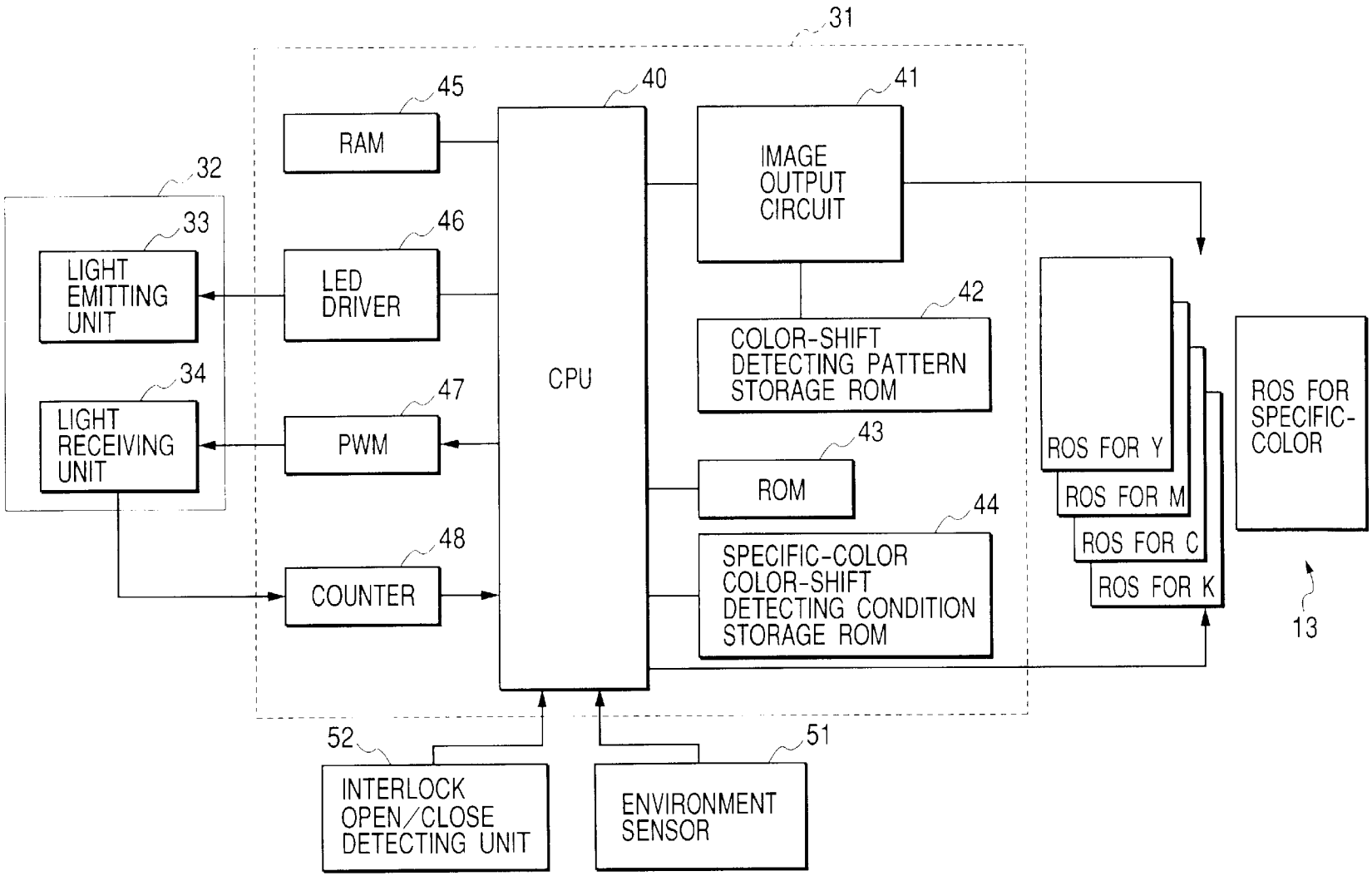
FIG. 2 is a block diagram used to explain a function of a control unit.

FIG. 2 is a schematic block diagram for explaining functions of the control unit 31. The control unit 31 includes a CPU 40, an image output circuit 41, a color-shift detecting pattern storage ROM 42, and a ROM 43. The CPU 40 controls the image forming operations and color-shift detecting operations/calibration operations of the tandem type digital color electrophotographic machine. The image output circuit 41 outputs image information and/or an image used to form the color-shift detecting pattern in response to an instruction issued from the CPU 40. The color-shift detecting pattern storage ROM 42 previously stores thereinto the image information of the color pattern detecting pattern. The ROM 43 previously stores thereinto a computer program used to control the image forming operation and/or the color-shift detecting operation/calibration operation, which are executed by the CPU 40. Also, the control unit 31 includes a specific-color color-shift detecting condition storage ROM 44, which stores thereinto the above-explained various sorts of conditions used to detect the specific-color color-shift. The image output circuit 41 outputs the image information and the color-shift detecting pattern information to the ROSs (ROS for Y color, ROS for M color, ROS for C color, and ROS for K color) of the exposing device corresponding to the commonly-used color image forming units 11Y, 11M, 11C, 11K, which form the commonly-used color images of Y, M, C, K. Further, the image output circuit 41 outputs the image information and the information of the color-shift detecting patterns to the ROS (namely, ROS for specific-color) of the exposing device 13 corresponding to the specific-color image forming apparatus 11S for forming the specific-color image. The specific-color color-shift detecting conditions storage ROM 44 also stores such a value by which the color-shift detecting operation is carried out based upon a different threshold value from that of the detecting operation for detecting the color shifts of the commonly-used colors.

Also, the control unit 31 includes a RAM 45, an LED driver 46, a PWM (pulse width modulation) circuit 47, and a counter 48. The RAM 45 stores thereinto various sorts of counter values, a total time of jobs, and execution information (temporal information) of a previous color-shift detecting process operation. The LED driver 46 turns ON a light emitting unit (for example, infrared LED) 33 of the pattern detecting sensor 32. The PWM circuit 47 controls a threshold value, which is used to sample data by a light receiving unit 34 of the pattern detecting sensor 32. The counter 48 measures a time (rising time) interval between predetermined pulses based upon a reference clock pulse when a color-shift detecting pattern outputted from the light receiving unit 34 of the pattern detecting sensor 32 is detected. It should also be noted that various sorts of signals derived from an external unit are entered into the CPU 40 of the control unit 31. As the external unit, there are provided namely, an environment sensor 51, which is constructed of, for example, a temperature sensor and a humidity sensor, and also an interlock open/close detecting unit 52, which detects open/close conditions of doors employed in the image forming apparatus. It should also be understood that the above-described PWM (pulse width modulation) circuit 47 may be replaced by other control methods.

Figure 3:
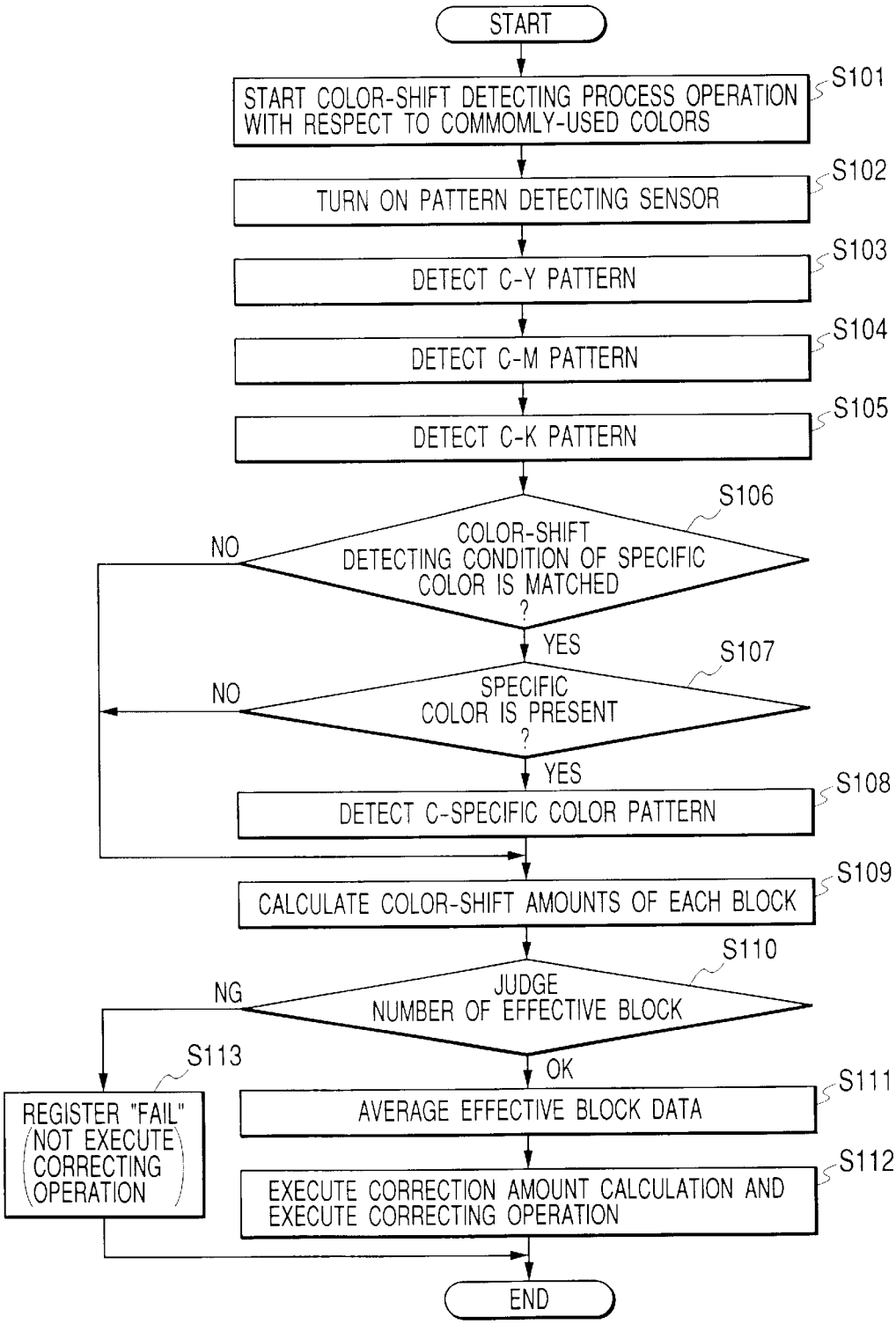
FIG. 3 is a flow chart for describing a color-shift control process operation executed in the control unit.

FIG. 3 is a flow chart for describing a process flow operation of color-shift controls executed by the control unit 31. The control unit 31 starts a color-shift detecting process operation with respect to the commonly-used colors (Y, M, C, K) at predetermined timing (step 101). The timing when the color-shift control operation is started may be arbitrarily set, depending upon a structure of an image forming apparatus, for example, when a power supply of the image forming apparatus is turned ON; when the interlock signal is received from the interlock open/close detecting unit 52; when a sleep mode is released; when a paper jam is removed; and when a date is changed after the preceding color-shift control operation is carried out. Also, for example, the color-shift detecting process operation may be carried out in such a case that a temperature change amount after the preceding color-shift control operation has been executed is increased by a predetermined temperature (for instance, 4° C.) based upon temperature information obtained from the environment sensor 51. In the color-shift detecting process operation, first of all, the pattern detecting sensor 32 is turned ON (step 102). Then, a C(cyan)-Y (yellow) pattern is detected (step 103), a C(cyan)-M (magenta) pattern is detected (step 104), and a C(cyan)-K (black) pattern is detected (step 105).

Thereafter, the control unit 31 judges as to whether or not current machine status or circumstance conditions are coincident with a starting condition of a color-shift detecting process operation of a specific-color with reference to-content of the specific-color color-shift detecting condition storage ROM 44 (step 106). The starting condition (starting timing) may be, as described above, a condition different from the process operation of the commonly-used color. For example, when the temperature increase is increased higher than that of the execution condition for the commonly-used colors, e.g., is increased by 6° C., the color-shift detecting process operation for the specific-color may be carried out by thinning, for example, one time several executions of the color-shift control process operations for the commonly-used colors, or several-day-executions thereof. In the case of not being coincident with the color-shift detecting condition of the specific-colors at the step 106, the process operation is advanced to a further step 109 by omitting the color-shift control operation of the specific-color. When being made coincident with the condition at the step 106, the control unit 31 confirms existence of the specific-color (step 107). When the specific-color is not present, the process operation is advanced to a step 109. When the specific-color is present, the process operation is advanced to the color-shift detecting process operation for the specific-color at which a C(cyan)-specific-color pattern is detected (step 108).

In the case that the C(cyan)-specific-color pattern is detected in this step 108, the image forming apparatus may be arranged in such a manner that the C-specific-color pattern is detected based upon the condition stored in the specific-color color-shift detecting condition storage ROM 44, which is different from the condition used to detect the commonly-used color. For example, in the case that the specific-color is such an image forming material which cannot be detected under the same condition as that for detecting the commonly-used color, the condition for detecting the specific-color must be changed. Concretely speaking, a threshold level is changed when a pattern is sensed by the pattern detecting sensor 32; a sensing gain of the pattern detecting sensor 32 is changed; a light amount is changed; a wavelength of a light source is changed; a filter of a light source unit is changed; a sort of light source is changed; a filter of a light receiving unit is changed; a wavelength of reception light is changed; a detecting element is changed; and also, a sort of pattern is changed. Also, for example, since a sensor of an ultraviolet light source is preferably used as to fluorescent pigment, in the case that a plurality of sensors are mounted as the pattern detecting sensor 32, these sensors may be switched.

Thereafter, the control unit 31 calculates a color-shift amount of each block based upon each of the detected patterns (step 109). Then, the control unit 31 judges a total number of effective blocks (step 110). When the judgement result is "OK", the control unit 31 averages effective block data (step 111), and calculates a correction amount. Thereafter, the control unit 31 executes the actual correcting operation (step 112), so that the process operation is accomplished. When the judgement result of the effective block number is "NG" in the step 110, the control unit 31 registers information of "fail" into, for example, the RAM 45 without executing the correcting operation (step 113). Then, the process operation is accomplished. In this case, as to the judgement of the effective block number executed in the step 110, for instance, the control unit 31 judges as to whether or not a total number of measurable combinations is larger than, or equal to a certain number.

Figure 4:
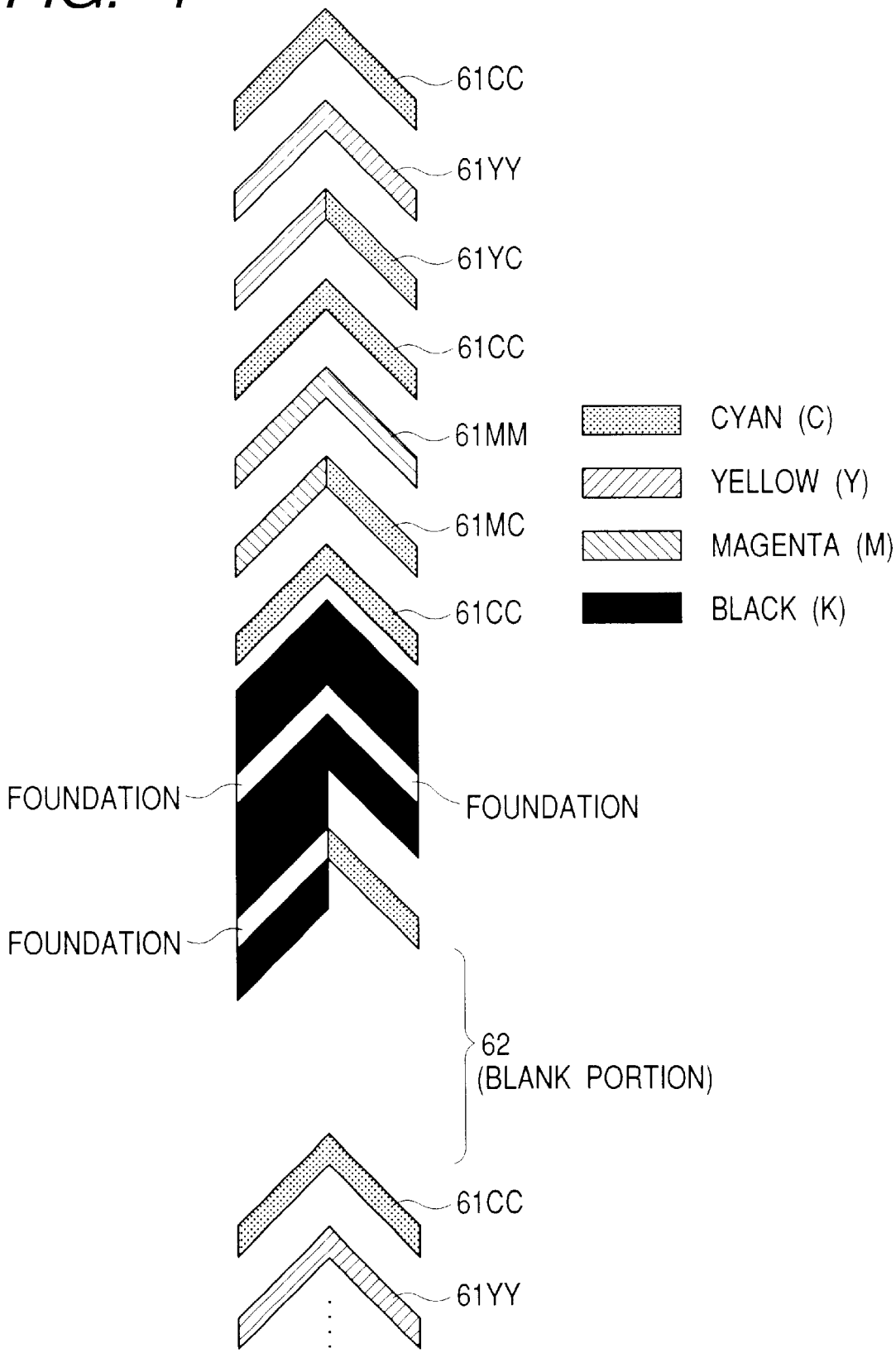
FIG. 4 is a diagram for explaining a color-shift detecting pattern to be formed.

FIG. 4 is an explanatory diagram for explaining a color-shift detecting pattern to be formed. As indicated in FIG. 4, a plurality of mountain-shaped marks 61 are formed on a non-image area, for example, on both ends of the transfer belt 21. In this case, while a first mountain-shaped mark 61CC, a second mountain-shaped mark 61YY, and a third mountain-shaped mark 61YC are employed as one unit, such patterns for combining all of colors to be measured with each other are used. The first mountain-shaped mark 61CC is made of a first color as a reference color. The second mountain-shaped mark 61YY is made of a second color corresponding to a color to be measured. The third mountain-shaped mark 61YC is made of both the first color and the second color. Also, in this embodiment, a blank portion 62 is provided which is used to detect a color shift with respect to a specific-color (will be discussed later in detail).

In this case, since these mountain-shaped marks 61 are written into the transfer belt 21, for example, in such a case that the transfer belt 21 is made in a dark color (namely, color having low reflectance not more than a predetermined threshold value) such as a black color, the mountain-shaped mark 61 formed by the black (K) toner can be hardly detected by employing the pattern detecting sensor 32. As a consequence, as to a portion (peripheral portion) where the black(K)-colored mountain-shaped mark 61 is formed, a foundation is previously formed by employing a toner having a light color (namely, color having high reflectance not less than a predetermined threshold value), for instance, a yellow(Y)-colored toner, and then, the mountain-shaped mark 61 made of the dark-colored toner such as a black(K)-colored toner is formed on this foundation. Then, a positional shift of the dark color such as the black (K) color can be grasped by measuring a positional shift of the foundation, which is observed from a notch of this mountain-shaped mark 61 formed on this foundation.

Figure 5:
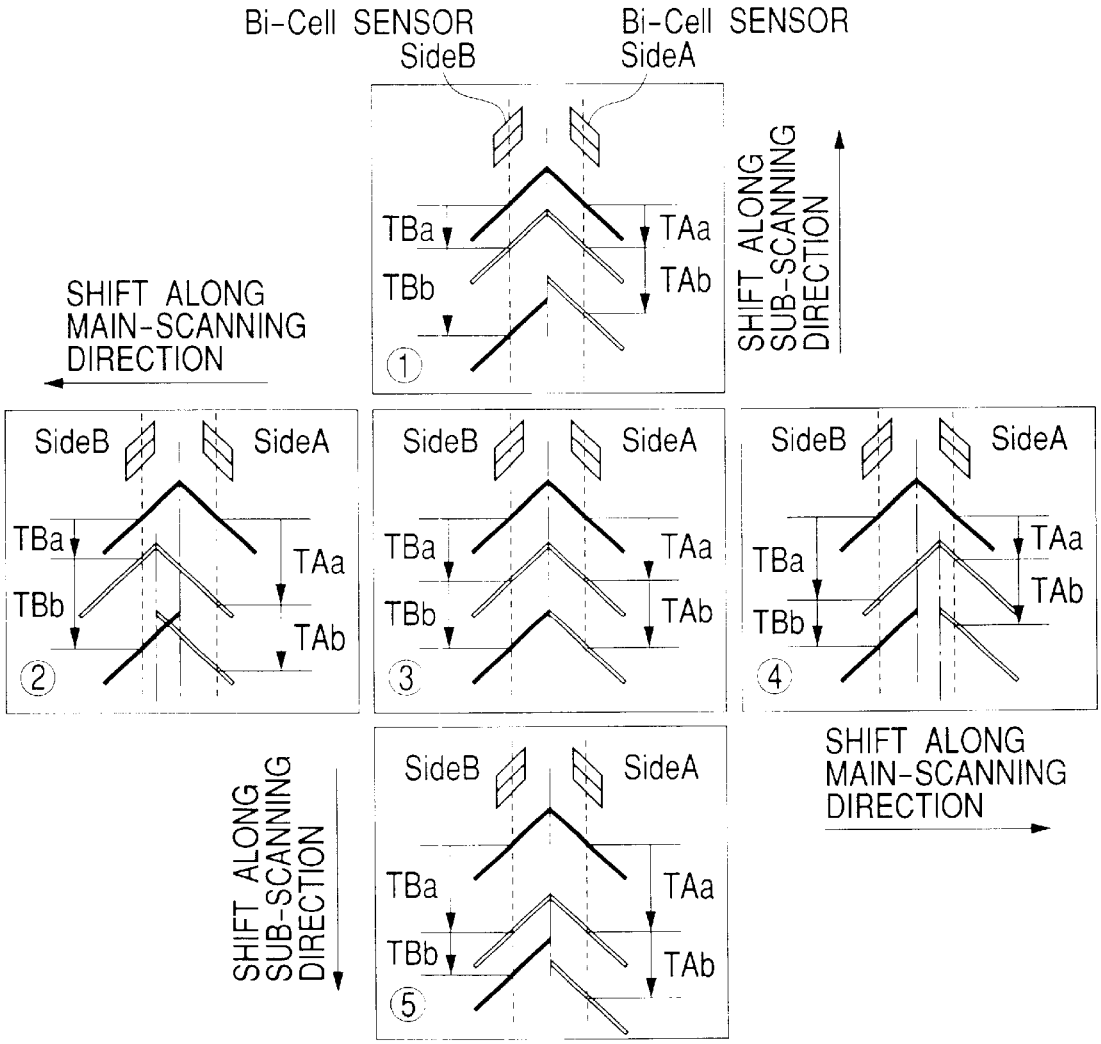
FIG. 5 is a diagram for explaining a principle idea capable of detecting a color-shift by employing a pattern detecting sensor.

FIG. 5 is an explanatory diagram for explaining a principle idea of a color-shift detection with employment of the pattern detecting sensor 32. FIG. 5(3) indicates an ideal patch arrangement, and a color shift amount is zero. At this time, intervals (TAa, TAb, TBa, TBb) of pulse outputs which are produced from both a side "A" and another side "B" are equal to each other. On the other hand, FIG. 5(2) and FIG. 5(4) indicate examples where color shifts are produced along a main scanning direction, in which intervals of pulse outputs are changed respectively, as compared with those obtained when the color shift amount becomes zero. Also, FIG. 5(1) and FIG. 5(5) represent such examples that color shifts are produced along a sub-scanning direction, in which intervals of pulse outputs are changed respectively, as compared with those obtained when the color shift amount becomes zero. Since the actual color shifts are independently produced at the same time along the main scanning direction and the sub-scanning direction, the above-described examples of FIG. 5 are combined with each other. However, these color shifts may be detected in such a manner that the color shifts between the two colors along both the main scanning direction and the sub-scanning direction may be detected based upon a difference between patch passing timing along the sub-scanning direction.

Next, a description now be made of arrangements of the respective image forming units 11 with respect to the transfer belt 21. For example, in the case that a color of this transfer belt 21 is blackish and also a color of an object to be measured is a dark color, as shown in FIG. 1, if the image forming unit 11 having a light color can be provided on the upstream side along the travel direction of the transfer belt 21, then a color shift of such a dark color can be easily detected. In the example shown in FIG. 1, the image forming unit 11Y for the yellow(Y) color corresponding to the light color is provided on the upstream side, and the image forming unit 11K for the black(K) color is provided on the down-stream direction. As a result, while the yellow(Y)-colored image is previously formed as a foundation, if the color-shift detecting pattern by the black (K) color is formed, then the color detection can be easily detected.

It should be noted that the method for forming another color pattern after the foundation has been formed may be similarly applied to the specific-color. For example, in such a case that a specific-color is resembled to the color of the transfer belt 21, for example, when the color of this transfer belt 21 is black (involving blackish colors, namely, color having low reflectance) and the specific-color is a dark color, a yellow (Y)-colored pattern functioning as a foundation is set on the transfer belt 21 having the black color, and a pattern having such a specific-color (namely, dark color) is overlapped on this yellow-colored foundation. If such a pattern forming method is carried out, even when the reflectance of the specific-color is low which is similar to the reflectance of the transfer belt 21, then the color-shift control operation can be carried out. However, when this pattern forming method, is employed, for example, as indicated in FIG. 1, in such a case that the specific-color image forming unit 11S is provided, on the uppermost stream side along the travel direction of the transfer belt 21, while the yellow-colored image formed by the commonly-used color image forming unit 11Y for the yellow(Y) color is formed as the foundation the pattern formed by the specific-color image forming unit 11S cannot be overlapped on this yellow-colored image. As a consequence, in the case that a specific-color is resembled to the color of the transfer belt 21, while the above-described first print-out speed is sacrificed, the specific-color image forming unit 11S is preferably provided on the down-stream side of the image forming unit 11. Furthermore, when the above-described ideas are extensively applied, for instance, in such a case that a plurality of the above-described specific-color image forming units 11S are employed so as to form a plurality of specific-colors, these plural sets of specific-color image forming units 11S may be arranged on the upstream side, or the down-stream side in response to brightness degrees thereof by considering a relative relationship between the transfer belt 21 and these plural specific-color image forming units 11S.

Figure 6:
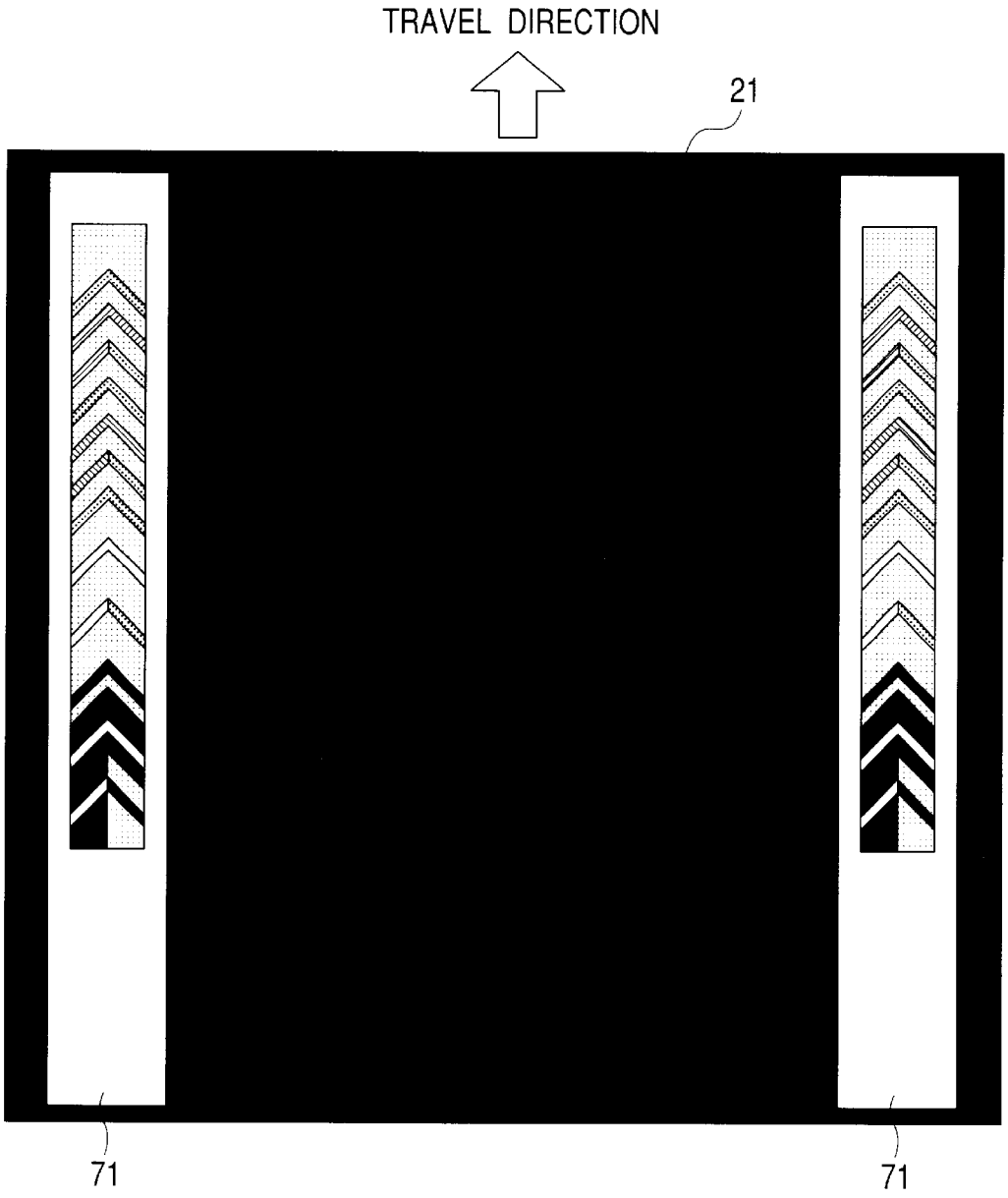
FIG. 6 is a diagram for representing a portion of a transfer belt where a drawing area is formed.

Also, in the case that a specific-color is a dark color, the specific-color image forming unit 11S for forming this specific-color must be provided on the upstream side, and furthermore, the color of the transfer belt 21 is black (alternatively, blackish color, reflectance thereof is low), as indicated in FIG. 6, a drawing area 71 for a color-shift detecting pattern whose color is, for example, a white-series color, is formed, and also, another color-shift detecting pattern containing a dark specific-color is drawn in this drawing area 71. FIG. 6 is a diagram for illustrating a portion of the transfer belt 21 where the drawing area 71 is formed. Since such a structure is formed, for instance, even when reflectance of a specific-color and reflectance of the transfer belt 21 are low, a color-shift control operation of the specific-color can be carried out by the pattern detecting sensor 32. It should also be noted that the reflectance as to both ends of the transfer belt 21 is different from each other in the example shown in FIG. 6. Alternatively, for example, while a place where "b" pieces of color-shift detecting patterns corresponding to the commonly-used colors are drawn is changed from another place where "a-b" pieces of color-shift detecting patterns are drawn, this area on which "a-b" pieces of color-shift detecting patterns are superimposed may be made different from other areas as to colors, transmittance, or reflectance of these areas. Also, as illustrated in FIG. 6, for instance, a similar drawing area 71 may be provided at a center portion of the transfer belt 21 other than both ends of the transfer belt 21 along the direction perpendicular to the travel direction of this transfer belt 21.

In this case, in accordance with this embodiment, as one example, as represented in FIG. 4, a blank portion 62 in which a portion into which a specific-color pattern is entered is made blank is provided in a color-shift detecting pattern which is formed when the color-shift control operation of the commonly-used color is carried out. As previously explained, the color-shift control operations of the commonly-used colors (Y, M, C, K) are relatively frequently carried out. However, as the specific-color, the frequency of the color-shift control operation is lowered by way of, for instance, thinning operation. At this time, a provision of a new detecting algorithm in order to execute a color-shift control operation of a specific-color is not preferable in view of a complication of algorithms. As a consequence, in the example shown in FIG. 4, when the blank portion 62 is provided and the color-shift control operation as to the specific-color is omitted, the region of this portion is made blank, so that it is possible to avoid a complication of an algorithm for a pattern detection. In other words, in an image forming apparatus having "a" pieces of image forming units 11, in the case that "b" pieces of color-shift control operations corresponding to the commonly-used colors are carried out, the color-shift detecting pattern is formed as a blank portion in the portion into which (a-b) pieces of image forming units 11 are entered. As a consequence, in this blank portion, a unit capable of detecting at least a color shift of a specific-color can be secured (for example, if specific-color is one color, then such a space into which three mountain-shaped marks 61 are entered can be secured).

It should also be understood that, for example, a portion of the mountain-shaped marks 61 for the commonly-used colors is replaced without providing such a blank portion, and the mountain-shaped mark 61 of the specific-color may be drawn instead of a portion of this commonly-used color. In the case that the photosensitive member provided in each of the image forming units 11 is, for example, small, this color-shift detecting pattern must be entered in a narrow pitch. In this case, the provision of the blank portion 62 for the specific-color is not preferable. Also, even in such a case that, for example, a narrow region (called as "inter-image") between image information and next image information is utilized so as to perform a color-shift control operation, the provision of the blank portion 62 for the specific-color is not preferable. As a consequence, even in these cases, the arrangement may be preferably made in such a way that the mountain-shaped mark 61 of the specific-color is drawn instead of a portion of this commonly-used color.

Figure 7:
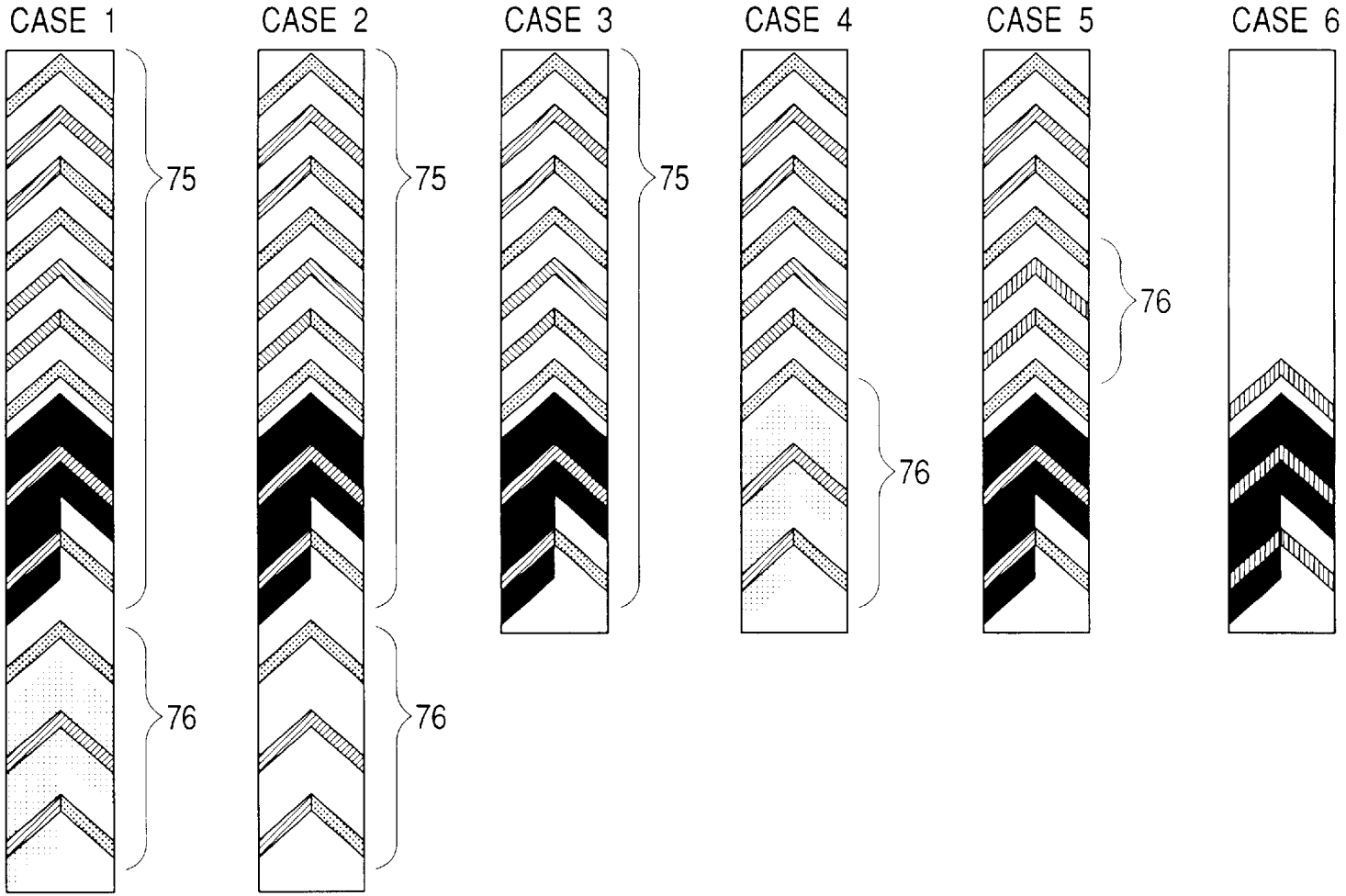
FIG. 7 is a diagram for representing a pattern example in the case that the color of the transfer belt is black.
Figure 8:
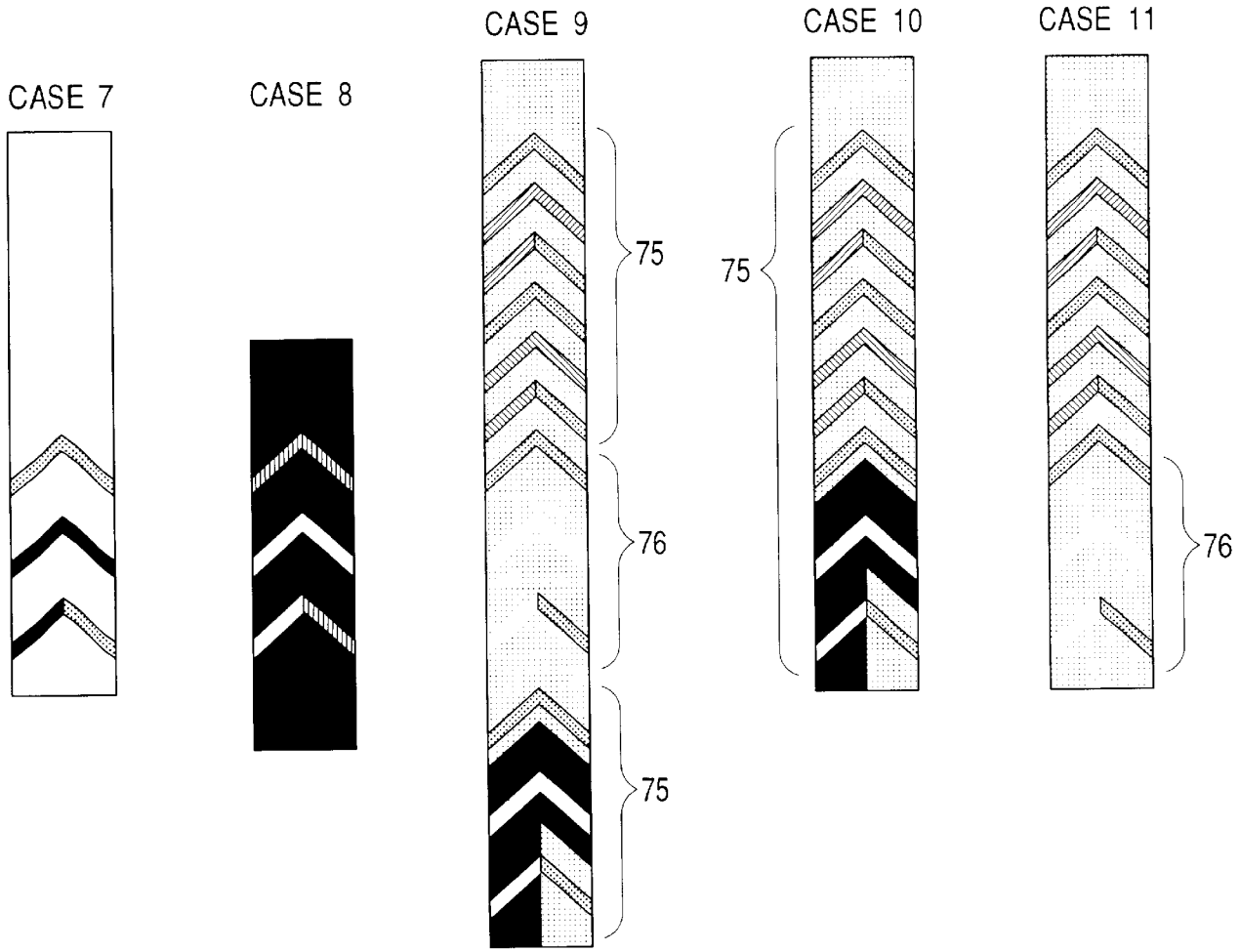
FIG. 8 is a diagram for indicating a pattern example is the case that the color of the transfer belt is white.

FIG. 7 and FIG. 8 are diagrams for indicating an example of color-shift detecting patterns. FIG. 7 shows an example of a pattern in the case that the color of the transfer belt 21 is black (namely, reference is low), and FIG. 8 represents an example of a pattern in the case that the color of the transfer belt 21 is white (namely, reflectance is high). Both a case 1 and a case 2 indicated in FIG. 7 show such a case that a specific-color detecting pattern 76 for detecting a color shift of a specific-color is additionally provided in addition to a commonly-used color detecting pattern 75 for Y, M, C, K. In the case 1, the specific-color is a dark color. In the case 2, the specific-color is a light color. A case 3, a case 4, and a case 5 represent such an example that the specific-color detecting pattern 76 is formed by replacing the commonly-used color detecting pattern 75. In the case 4, since the specific-color is a dark color, the specific-color detecting pattern 76 is formed by replacing the black (K) color. In the case 5, the specific-color detecting pattern 76 is formed by replacing, for instance, the magenta (M) color. A case 6 shows such a case that a specific-color is a light color in an image forming apparatus which uses only this specific-color and a black (K) color as the image forming unit 11. In this case, while the specific-color is employed as a foundation, the black color is overlapped on this specific-color so as to form a color-shift detecting pattern.

On the other hand, in the case that the color of the transfer belt 21 shown in FIG. 8 is a white color, in a case 7, while a specific-color is a dark color, a color-shift detecting pattern is indicated in an image forming apparatus which uses only the specific color and a black (K) color. In a case 8, a specific-color is a light color, a patch-having the specific-color is formed on a black (K) color, and a color control operation is carried out. In a case 9 to a case 11, specific-colors are dark colors, and the specific-color image forming unit 11S is located at the uppermost stream of the image forming unit 11. In this case, while the specific-colors are used as foundations, patches having various colors are formed. The case 9 indicates all of the patches made in the commonly-used colors of Y, M, C, K, and the specific-color. The case 10 indicates such an example that color-shift detecting patterns made in four colors except for the specific-color are formed. The case 11 shows such an example that color-shift detecting patterns made in four colors except for the black (K) color corresponding to the commonly-used color are formed. In the case 9 to the case 1, the color shifts of the specific-colors can be detected at white-blank portions.

As previously explained in detail, in accordance with this embodiment, the color-shift control operation can be carried out with respect to such a specific-color (specific image forming member) which could not be conventionally detected by the conventional color-shift control operation. At this time, for example, a user may alternatively select as to whether or not the color-shift control operation is carried out with respect to specific-colors, or some of these specific-colors, otherwise all of the specific-colors. This user selection may be instructed from, for example, a control panel employed in an image forming apparatus. Alternatively, an image forming apparatus may be arranged as follows: That is, while this image forming apparatus studies a use frequency of a specific-color, this image forming apparatus may automatically select as to, for instance, whether or not a color-shift control operation is carried out with respect to all of the image forming units 11, or with respect to only commonly-used colors, otherwise with respect to a specific-color.

Also, in accordance with this embodiment, while the pattern detecting sensor 32 corresponding to the reflection type sensor is employed, a selection is made how to draw color-shift detecting patterns based upon reflectance of an image forming member such as a toner and the reflectance of the transfer belt 21, and then, a color-shift control operation may be carried out by the selected color-shift detecting pattern. There are, for example, a method for solely drawing a color-shift detecting pattern on the transfer belt 21; a method by which a color having high reflectance is formed as a foundation, a color having low reflectance is formed to mask this foundation in such a manner that a portion of this foundation can be observed; and another method by which a color having low reflectance is formed as a foundation, and a pattern made in another color having high reflectance is drawn on this foundation. At this time, such a fact as to whether (a-b) pieces of specific-color image forming units 11 among (a) pieces of the image forming units 11 correspond to dark colors (low reflectance) or light color (high reflectance) may be automatically judged in accordance with a method that, for example, the specific-color image forming unit 11S, or a toner bottle, otherwise an ink cartridge owns a memory into which information as to this color material has been written, and then, this stored information is recognized by the control unit 31. Alternatively, another automatic judging method may be realized. That is, after such a fact that the specific-color image forming unit 11S, or the toner bottle, otherwise the ink cartridge is mounted has been sensed, a patch having a specific-color is outputted by the control unit 31 before an image is outputted, this patch is sensed by the pattern detecting sensor 32, and thus, the characteristic (dark/light) of the specific-color is automatically judged based upon an output value of this pattern detecting sensor 32. Furthermore, another method may be employed by which in such a case that a color member having extremely high reflectance is used, a pattern to be formed is made in low concentration.

It should also be understood that in this embodiment, the transfer belt 21 is employed as the intermediate transfer member. Alternatively, while the recording sheet formed on this transfer belt 21 is transported, images made in various colors may be directed transferred onto this recording sheet. For instance, a color-shift detecting pattern may be formed with respect to a transfer member (namely, transfer member carrier) such as a paper transport belt. Also, a color-shift detecting pattern may be formed not only on the transfer belt 21, but also on the recording sheet. Thus, the color-shift detecting pattern may be visibly confirmed by a user. In addition, this embodiment may be similarly applied to color-shift adjustments of specific-colors executed in image forming systems such as an ink-jet system, and a thermal head system other than an electronic photographic system. In addition, this embodiment may be similarly applied to another new embodiment such as a hybrid mode that a color-shift control operation as to commonly-used colors is performed by an electronic photographic system, whereas a color-shift control operation as to a specific-color is performed by an ink-jet system.

As previously described in detail, in accordance with the present invention, while the color-shift control operations are carried out in a plurality of image forming units, the suitable color-shift control operations can be performed which are fitted to the features of these image forming units.

What is claimed is:

1. An image forming apparatus comprising:

a plurality of image forming units; and a color-shift control unit for executing a color-shift control operation with respect to the image forming units, wherein the color-shift control unit has:

a first control unit for executing a first color-shift control operation with respect to a part of the image forming units among the plurality of image forming units; and a second control unit for executing a second color-shift control operation with respect to some or all of the remaining image forming units.

2. The image forming apparatus according to claim 1, wherein the second control unit executes the second color-shift control operation based upon a use condition of the plurality of image forming unit.

3. The image forming apparatus according to claim 1, further comprising:

a pattern forming unit for forming a color-shift detecting pattern; and a sensor for sensing the color-shift detecting pattern, wherein a detection level of the sensor is switched between the first and second color-shift control operations.

4. The image forming apparatus according to claim 1, further comprising:

a pattern forming unit for forming a color-shift detecting pattern; and a sensor for sensing the color-shift detecting pattern, wherein the pattern is switched between the first and second color-shift control operations.

5. The image forming apparatus according to claim 4, wherein the pattern for the first color-shift controlling is a pattern in which a portion of the pattern for the second color-shift controlling is dropped.

6. A color-shift control method comprising the steps of:

forming a first pattern by a part of a plurality of image forming units;

forming a second pattern including patterns for the some or all of the remaining image forming units;

controlling color-shift of the part of the plurality of image forming unit by using the first pattern at a first predetermined timing; and controlling color-shift of the some or all of the remaining image forming units by using the second pattern at a second predetermined timing.

7. The color-shift control method according to claim 6, wherein the first pattern is a pattern of a color shift of which a user can visibly confirm.

8. The color-shift control method according to claim 6, wherein the first pattern is a pattern used for a coarse adjustment.

9. The color-shift control method according to claim 6, wherein the first and second patterns are formed on an image recording sheet.

10. An image forming apparatus comprising:

a transfer unit;

a plurality of commonly-used color image forming units arranged side by side with respect to the transfer unit, for forming a yellow image, a magenta image, a cyan image, and a black image;

a specific-color image forming unit for forming a specific-color image, which is arranged in at least one of an upstream side and a lower-stream side of the commonly-used color image forming units with respect to a sequence of forming the color images by the commonly-used color image forming units; and a control unit for executing a color-shift control operation by using at least one of the commonly-used color image forming units and the specific-color image forming unit, wherein the control unit has:

a first control unit for executing the color-shift control operation using the commonly-used color image forming units; and a second control unit for executing the color-shift control operation using the specific-color forming unit.

11. The image forming apparatus according to claim 10, wherein the transfer unit has a drawing area of a color-shift detecting pattern, which is formed by the specific-color image forming unit, in a discriminative manner with respect to other areas.

12. An image forming apparatus comprising:

a transfer unit;

a plurality of commonly-used color image forming units arranged side by side with respect to the transfer unit, for forming a yellow image, a magenta image, a cyan image, and a black image;

a specific-color image forming unit for forming a specific-color image, which is arrange in at least one of an upstream side and a lower-stream side of the commonly-used color image forming units with respect to a sequence of forming the color images by the commonly-used color image forming units; and a control unit for executing a color-shift control operation by using at least one of the commonly-used color image forming units and the specific-color image forming unit, wherein when the specific-color has reflectance not less than a predetermined threshold value, the specific-color image forming unit is arranged in the upstream side of the commonly-used image forming units.

13. An image forming apparatus comprising:

a transfer unit;

a plurality of commonly-used color image forming units arranged side by side with respect to the transfer unit, for forming a yellow image, a magenta image, a cyan image, and a black image;

a specific-color image forming unit for forming a specific-color image, which is arrange in at least one of an upstream side and a lower-stream side of the commonly-used color image forming units with respect to a sequence of forming the color images by the commonly-used color image forming units; and a control unit for executing a color-shift control operation by using at least one of the commonly-used color image forming units and the specific-color image forming unit, wherein when the specific-color has reflectance not more than a predetermined threshold value, the specific-color image forming unit forms a color-shift detecting pattern on an image having reflectance not less than the predetermined threshold value, which is formed by the commonly-used forming units.

* * * * *